US005417874A

United States Patent [19]

Carlson et al.

[11] Patent Number: 5,417,874

[45] Date of Patent: May 23, 1995

[54] METHOD FOR ACTIVATING ATOMICALLY POLARIZABLE ELECTRORHEOLOGICAL MATERIALS

[75] Inventors: J. David Carlson, Cary, N.C.; Keith D. Weiss, Eden Prairie, Minn.

[73] Assignee: Lord Corporation, Erie, Pa.

[21] Appl. No.: 169,615

[22] Filed: Dec. 16, 1993

Related U.S. Application Data

[62] Division of Ser. No. 829,137, Jan. 31, 1991, Pat. No. 5,294,360.

[51] Int. Cl.[6] ..... C10M 169/04; C10M 171/00

[52] U.S. Cl. ..... 252/74; 252/73; 252/572

[58] Field of Search ..... 252/74, 73, 572

[56] References Cited

U.S. PATENT DOCUMENTS

| | | | |
|---|---|---|---|
| 3,047,507 | 7/1962 | Winslow | 252/75 |
| 4,702,855 | 10/1987 | Goossens et al. | 252/75 |
| 4,879,056 | 11/1989 | Filisko et al. | 252/74 |
| 5,122,292 | 6/1992 | Eusebi et al. | 252/75 |
| 5,130,040 | 7/1992 | Bloink et al. | 252/74 |
| 5,139,691 | 8/1992 | Bloink et al. | 252/74 |

FOREIGN PATENT DOCUMENTS 3-255196 11/1991 Japan .

OTHER PUBLICATIONS

Lazareva et al, "Effect of an Electric Field on the Rheological Properties of a Suspension of Titanium Dioxide in Solutions of Cellulose Ethers", *Kolloidnyi Zhurnal*, vol. 52, No. 1, Jan./Feb. 1990, pp. 141–144.

Chertkova et al, "Influence of Nature of Surfactant on the Electrorheological Effect in Nonaqueous Dispersions", *Kolloidnyi Zhurnal*, vol. 44, No. 1, Jan./Feb. 1982, pp. 83–90.

Matsepuro, "Structure Formation in an Electric Field and the Composition of Electrorheological Suspensions", translated from Electroreol. Issled: Pril; Minsk, pp. 27–51, 1981.

Otsubo/Watanabe; "Electrorheological Behavior of Barium Titanate Suspensions," *Journal of the Society of Rheology*, (Japan), vol. 18, 1990, pp. 111–116.

*Primary Examiner*—Christine Skane

[57] ABSTRACT

An electrorheological material comprising a carrier fluid and an atomically, polarizable particle component. The atomically polarizable particle component has a crystalline lattice structure which allows atoms to shift position with respect to each other in response to the application of an electric field. The electrorheological materials are subjected to an alternating current electric field at a frequency of at least 500 Hz. The materials exhibit substantial electrorheological activity over a broad temperature range.

17 Claims, 3 Drawing Sheets

Atomically Polarizable Electrorheological Material (Example 23)

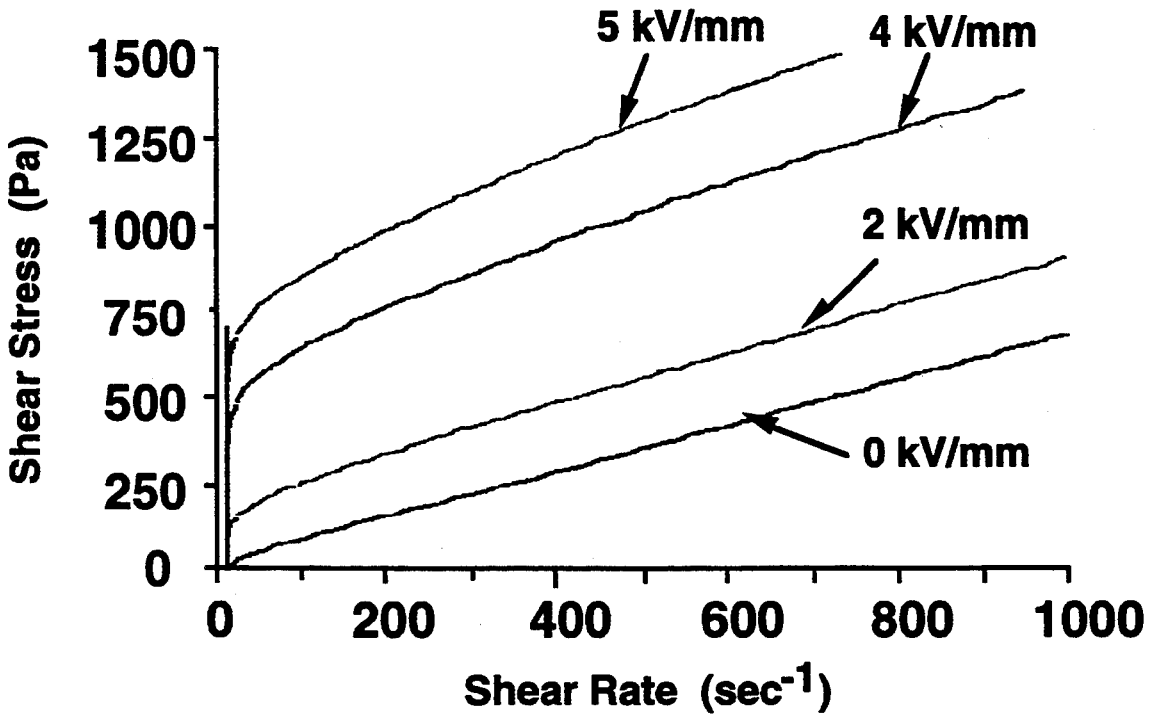
Figure 1 - Rutile $TiO_2$-Based Electrorheological Material (Example 1)

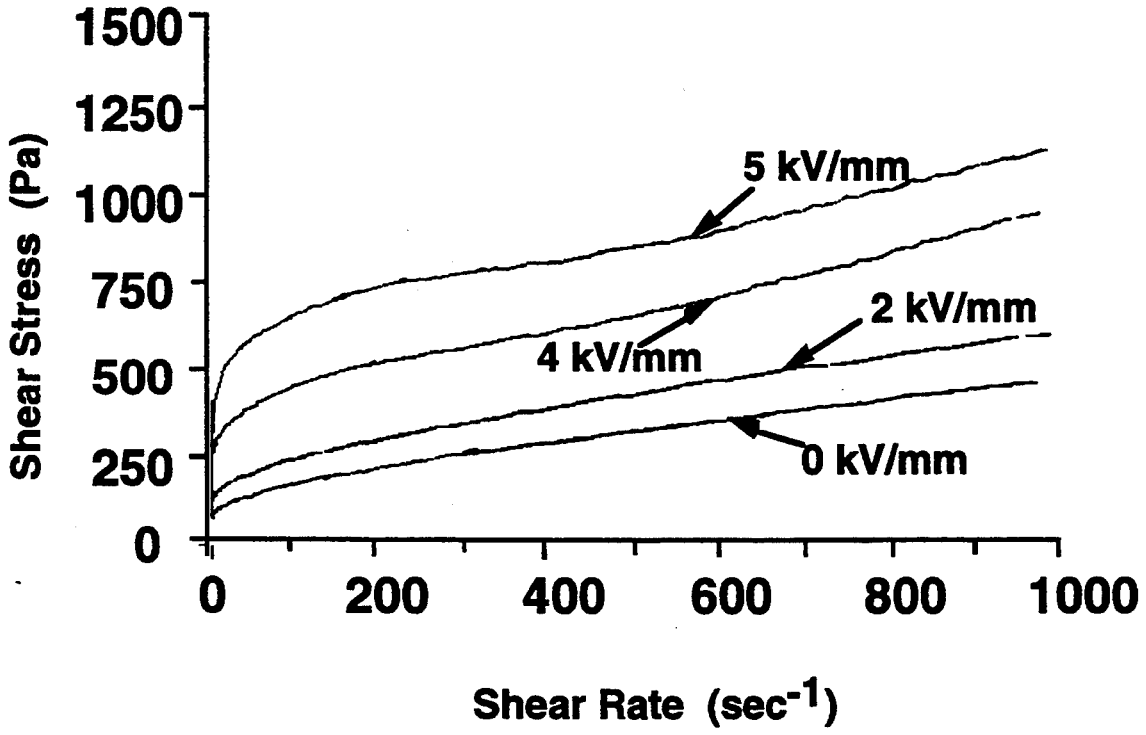
Figure 2 - Anatase $TiO_2$-Based Electrorheological Material (Example 2)

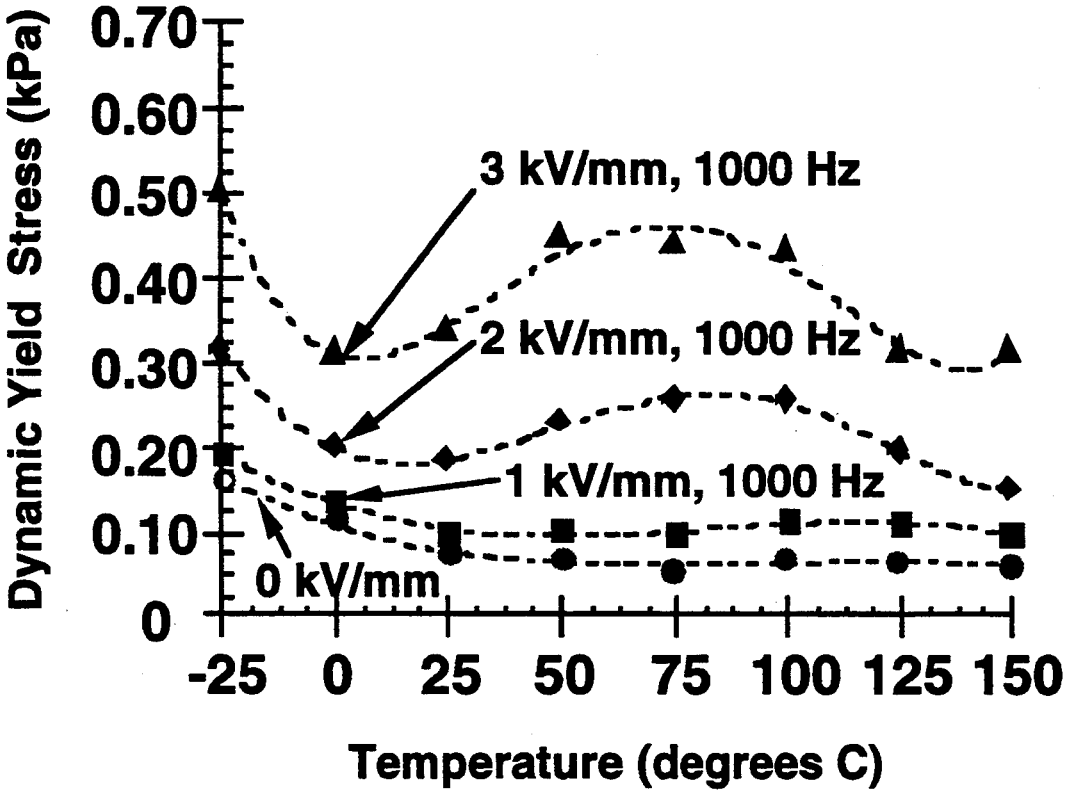
Figure 3 - Atomically Polarizable Electrorheological Material (Example 23)

METHOD FOR ACTIVATING ATOMICALLY POLARIZABLE ELECTRORHEOLOGICAL MATERIALS

This is a divisional of application Ser. No. 07/829,137, filed on Jan. 31, 1992, now U.S. Pat. No. 5,294,360.

FIELD OF THE INVENTION

The present invention relates to certain fluid materials which exhibit substantial increases in flow resistance when exposed to electric fields. More specifically, the present invention relates to broad temperature range electrorheological materials which undergo atomic polarization upon exposure to an alternating current electric field at high frequencies.

BACKGROUND OF THE INVENTION

Fluid compositions which undergo a change in apparent viscosity in the presence of an electrical field are commonly referred to as electrorheological fluids or materials. Electrorheological materials normally are comprised of particles dispersed within a carrier fluid and in the presence of an electrical field, the particles become polarized and are thereby organized into chains of particles within the fluid. The chains of particles act to increase the apparent viscosity or flow resistance of the overall fluid and in the absence of an electric field, the particles return to an unorganized or free state and the apparent viscosity or flow resistance of the overall material is correspondingly reduced.

An electrorheological fluid composed of a non-conductive solid dispersed within an oleaginous fluid vehicle is described in U.S. Pat. No. 3,047,507. The compositions contain a minimum amount of water and a minimum amount of a surface active dispersing agent and the non-conductive solid consists of finely divided particles having an average diameter of from about 0.1 to about 5 microns.

A method of inducing a change in dynamic torque transmission of an electrorheological fluid in response to an electric field at low current is disclosed in U.S. Pat. No. 4,879,056. The method involves selecting a non-conductive liquid phase and dispersing in the liquid phase an alumino silicate particulate phase which is substantially free of adsorbed water. The resulting electrorheological fluid is then subjected to an electric potential in excess of about 1 kV at a current density of less than about 1/3 microamp per square inch.

U.S. Pat. No. 4,702,855 discloses electrorheological fluids consisting of an aluminum silicate solid dispersed within a fluid medium wherein the aluminum/silicate atomic ratio on the surface of the aluminum silicate is in the range of 0.15 to 0.80. The aluminum silicates may be either amorphous or crystalline and may contain contaminants such as $Fe_2O_3$, $TiO_9$, CaO, MgO, $Na_2O$, and $K_2O$. The electrorheological fluids may optionally contain an effective quantity of an appropriate dispersing agent.

As described above, the particles of electrorheological materials undergo polarization so as to be organized into chains of particles within the carrier fluid. The polarizability of particles traditionally utilized in electrorheological materials has typically been a function of the surface or bulk ionic conductivity of the particles themselves. Polarization resulting from surface or bulk ionic conductivity arises from the free migration of charged particles throughout the particle structure into positive and negative regions in response to an electric field. This type of particle conductivity has typically been achieved by the addition of an activator such as water to the particle component or by selecting a particle component which has a crystalline structure which enables cations to move freely through the structure. As a result, the electrorheological activity of many traditional electrorheological materials is dependent on the surface or bulk ionic conductivity of the particle component utilized in the overall material. This dependence on the ionic conductivity of the particle component causes the electrorheological material to be relatively sensitive to changes in temperature since both the mobility and concentration of charge carriers such as cations and anions are a function of temperature.

A need therefore exists for an electrorheological material which does not depend on the surface or bulk ionic conductivity of the particle component. Such an electrorheological material would be capable of functioning over a broad temperature range, which is desirable in many applications involving varying temperature conditions.

SUMMARY OF THE INVENTION

The present invention is an electrorheological material which functions independently of the conductivity of the particle component. It has presently been discovered that the utilization of certain atomically polarizable particles in combination with an alternating current electric field having a frequency of at least 500 Hz results in an electrorheological material which is capable of functioning over a broad temperature range and which responds relatively quickly upon exposure to the high frequency field.

The electrorheological material of the present invention comprises an atomically polarizable particle component dispersed within a carrier fluid. The atomically polarizable particle component is characterized by the ability of atoms within the bulk lattice structure to slightly shift position with respect to each other in order to reorient or align the dipole in response to the application of an electric field. It has been discovered that crystalline lattice structures that undergo a distortion in the presence of an electric field so as to result in atomic polarization can effectively function as electrorheologically active particles. This atomic polarization, which is independent of the surface or bulk conductivity of the particle component, allows the particles to form chains or rows within the carrier fluid which results in a substantial electrorheological effect over a broad temperature range.

The use of a high frequency alternating current electric field in combination with atomically polarizable particles is necessary to reduce or eliminate parasitic electrophoretic effects. Parasitic electrophoretic effects are defined as an electric field-induced migration of charged particles towards one electrode. These electrophoretic effects are particularly prevalent in substantially anhydrous electrorheological materials exposed to either direct current or low frequency alternating current electric fields. The ability of the particles to form chains within the carrier fluid is inhibited by the electrophoretic effects and the electrorheological material exhibits a reduced electrorheological response. It has been discovered that the use of high frequency alternating current electric fields in conjunction with atomically polarizable particles essentially eliminates parasitic electrophoretic effects and results in a situation where the static and dynamic yield stress values exhibited by the electrorheological material are approximately equivalent. This type of situation is advantageous for the design of basic device components as explained hereinafter.

The present invention also relates to a method of activating an electrorheological material by providing an appropriate carrier fluid, dispersing an atomically polarizable particle within the carrier fluid and exposing the resulting electrorheological material to an alternating current electric field at a frequency of at least 500 Hz.

BRIEF DESCRIPTION OF THE DRAWINGS

FIGS. 1 and 2 are graphs showing shear rate versus dynamic shear stress data for the atomically polarizable electrorheological materials of Examples 1 and 2, respectively, at various alternating current electric fields and a frequency of 500 Hz.

FIG. 3 is a graph showing the temperature versus dynamic yield stress data for the atomically polarizable electrorheological material of Example 23 obtained at A.C. electric fields (frequency = 1000 Hz) ranging from 0 to 3 kV/mm.

DETAILED DESCRIPTION OF THE INVENTION

The atomically polarizable component of the present invention can be essentially any crystalline particle which is composed of ionic crystals in which positive ions and negative ions can slightly shift relative to each other in the presence of an applied electric field. This slight shift of positive and negative ions relative to each other is distinguishable from the free migration of both ions to separate positive and negative regions in the particle. Large atomic polarization is typically found in those crystallographic groups which are non-centrosymmetric, i.e., they lack a center of inversion symmetry and are inherently asymmetric. Of the thirty-two recognized crystallographic point groups, twenty exhibit asymmetric properties. These groups can be identified by crystal system [point group] notations as Triclinic [1], Monoclinic [2], Monoclinic [m], Orthorhombic [mm2], Orthorhombic [222], Tetragonal [4], Tetragonal [4mm], Tetragonal [$\bar{4}$], Tetragonal [42m], Tetragonal [22], Trigonal [3], Trigonal [3m], Trigonal [32], Hexagonal [6], Hexagonal [6mm], Hexagonal [$\bar{6}$], Hexagonal [$\bar{6}$ m2], Hexagonal [622], Cubic [$\bar{3}$ m], and Cubic [23]. Each of these groups has one or more polar axes and thus can exhibit various polar effects such as piezoelectricity, pyroelectricity, ferroelectricity or large atomic polarization. A predominant share of the materials showing large atomic polarization belong to the tetragonal crystal class. A more detailed description of known crystal classes and point groups is provided by Hench and West in "Principles of Electronic Ceramics" (J. Wiley & Sons: New York, 1990, pp. 237–240), which is incorporated herein by reference.

Atomically polarizable particles will exhibit either paraelectric or ferroelectric behavior. Paraelectric particles are characterized by the absence of any net dipole when an electric field is not present. The formation of a dipole in these particles is induced through the lattice structure upon the application of an electric field. On the other hand, ferroelectric particles normally contain a net dipole in the absence of an electric field. These particles are characterized by the ability of the existing dipoles to switch or realign upon the application of an electric field. A more detailed description of atomic polarization is provided by Pohl in "Dielectrophoresis" (Cambridge University Press, New York, 1978), the entire contents of which is incorporated herein by reference.

Specific examples of atomically polarizable compounds which can be utilized as the particle component of the present invention include titanium dioxide, lithium niobate, sodium chloride, potassium dihydrogen phosphate, lead magnesium niobate, barium titanate, strontium titanate, lead titanate, lead zirconate titanate and, mixtures thereof. The preferred particle components of the present invention are titanium dioxide, barium titanate and lead zirconate titanate.

It should be noted that there are several different structural forms of titanium dioxide. Specifically, titanium dioxide can exist in either futile, anatase or brookite forms. It has been discovered that the futile form of titanium dioxide is substantially preferred over the other structural forms for purposes of the present invention. This is believed to be in part due to the high dielectric constant of the futile form versus the lower dielectric constants of the other forms of titanium dioxide. Since the dielectric constant is a measure of the amount of atomic polarization the particles can undergo, a higher dielectric constant will correlate with a greater electrorheological effect.

Several of the particle components of the invention can be commercially obtained in various grades. For example, titanium dioxide is available from E. I. Du Pont de Nemours & Co. (Wilmington, Del.) as TI-PURE ® in 7 grades, which vary in the percentage of titanium dioxide pigment content and in the degree and type of surface treatment. It has been discovered that small variations in pigment content will not dramatically alter the electrorheological effect, while the presence of a surface coating on the pigment can aid in the dispersability of the particle in a carrier oil. Increased dispersibility can also lead to improved zero-field properties as described hereinafter. In this context, TI-PURE ®R-960, which is completely encapsulated with a silica layer, is the preferred grade of titanium dioxide.

The atomically polarizable particle component of the invention typically comprises from about 5 to 50, preferably about 15 to 40, percent by volume of the total electrorheological material. This corresponds to approximately 18 to 81, preferably 43 to 74, percent by weight when the carrier fluid and atomically polarizable particle of the electrorheological material have a specific gravity of about 1.0 and 4.3, respectively. The particular amount of particle component will depend upon the desired level of electroactivity and the viscosity of the overall electrorheological material with higher amounts of particle component resulting in higher viscosity and higher electroactivity.

Although not required for the observation of a substantial electrorheological effect, the electrorheological material of the present invention can tolerate the presence of a small amount of low molecular weight complexes commonly known as activators to those skilled in the art. The presence of these low molecular weight complexes in the electrorheological material of the present invention may result from improper purification and formulation procedures used to prepare the material. Typical low molecular weight complexes that may be present in small quantities include water and other molecules containing hydroxyl, carboxyl or amine functionality. A more detailed description of molecules normally considered as activators can be found in U.S. Pat. No. 5,075,021, which is incorporated herein by reference.

If present in the current electrorheological material, these low molecular weight molecules should be present in an amount less than about 5.0 percent by weight relative to the weight of the particle component. While the presence of a small amount of an activator may be tolerated in the current electrorheological material, it is preferred that no activator be utilized so as to minimize the conductivity of the overall electrorheological material and maintain uniform properties over a broad temperature range. Before use, the particles are preferably thoroughly dried by heating at 110°–150° C. for a period of time from about 3 hours to about 24 hours so as to remove any adsorbed water on the surface of the particle which might function as an activator. The ability of the present electrorheological material to function in the absence of water or other activator is advantageous in that it results in an electrorheological material capable of functioning at very high and very low temperatures.

The carrier fluid of the invention is a continuous liquid phase and may be selected from any of a large number of electrically insulating liquids known for use in electrorheological materials. Typical fluids useful in the present invention include mineral oils, silicone oils, white oils, paraffin oils, chlorinated hydrocarbons, transformer oils, halogenated aromatic liquids, halogenated paraffins, diesters, polyoxyalkylenes, perfluorinated polyethers, fiuorinated hydrocarbons, fiuorinated silicones and mixtures thereof. The carrier fluid should have a dielectric constant that is within the range from about 1 to 40, preferably from about 1 to 10. The carrier fluid should have a viscosity that is between about 0.5 and 1000 mPa-s, preferably between about 5 and 50 mPa-s. Oils having a dielectric constant between about 2.0 and 5.0 and a viscosity between about 10 and 20 mPa-s are the preferred carrier fluids of the invention. Specific preferred carrier fluids for purposes of the present invention include silicone oils, mineral oils, and perfluorinated polyethers. The carrier fluid of the present invention is typically utilized in an amount ranging from about 50 to 95, preferably from about 60 to 85, percent by volume of the total electrorheological material. This corresponds to approximately 19 to 82, preferably 26 to 57, percent by weight when the carrier fluid and atomically polarizable particle of the electrorheological material have a specific gravity of about 1.0 and 4.3, respectively.

The atomically polarizable particles of the present invention may be stabilized against flocculation and settling in the carrier fluid by the utilization of a dispersing agent or surfactant. Such stabilizing agents include known surfactants or dispersing agents such as the ionic surfactants discussed in U.S. Pat. No. 3,047,507 (incorporated herein by reference) but preferably comprise non-ionic surfactants such as the steric stabilizing amino-functional, hydroxy-functional, acetoxy-functional, or alkoxy-functional polysiloxanes such as those disclosed in U.S. Pat. No. 4,645,614 (incorporated herein by reference). Other steric stabilizers such as graft and block copolymers may be utilized as an additional surfactant for the present invention and such other steric stabilizers as, for example, block copolymers of poly(ethylene oxide) and poly(propylene oxide) are disclosed in detail in U.S. Pat. No. 4,772,407 (incorporated herein by reference) and in Napper, "Polymeric Stabilization of Colloidal Dispersions," (Academic Press, London, 1983). Fatty acid esters such as glycerol monooleate, glycerol dioleate, and glycerol monoisostearate can also be utilized as a dispersing agent for the present invention. Commercial surfactants commonly used in the paint industry, such as HYPERMER ® and SOLSPERSE ® hyperdispersants (ICI Americas, Inc.) also can be employed in the electrorheological material of the present invention. Many of the surfactants or dispersing agents need to be chemically purified prior to use in order to reduce or eliminate the presence of excess ionic contaminants which may interfere with broad temperature stability. These surface active agents also provide for a low zero-field viscosity and yield stress which is advantageous for the reasons described hereinafter.

For purposes of obtaining the high-temperature performance in the present invention, it has been discovered that particle-bound dispersing agents or surfactants are especially advantageous. Dispersing agents or surfactants found to be particularly adept at binding to the surface of the present atomically polarizable particles are coupling agents such as titanate, zirconate and aluminate coupling agents or combinations thereof. Specific examples of these coupling agents include isopropyltri(dioctyl)phosphato titanate, neopentyl(diallyl-)oxytri(dioctyl)pyrophosphato zirconate, and neopentyl(diallyl)oxytri(dioctyl)phosphato titanate. Titanate, zirconate and aluminate coupling agents are commercially available under the tradename KEN-REACT ® from Kenrich Petrochemicals, Inc.

A surfactant or dispersing agent, if utilized, is typically employed in an amount ranging from about 0.1 to 10, preferably about 0.5 to 4.0, percent by weight relative to the weight of the particle component.

The electrorheological materials of the present invention can be prepared by simply mixing together the carrier fluid, the particle component and surfactant. If the presence of water as an activator is to be minimized, the corresponding electrorheological material is preferably prepared by drying the particle component in a convection oven at a temperature of from about 110° C. to about 150° C. for a period of time from about 3 hours to about 24 hours. The ingredients of the electrorheological materials may be initially mixed together by hand with a spatula or the like and then subsequently more thoroughly mixed with a mechanical mixer or shaker or dispersed with an appropriate milling device such as a ball mill, sand mill, attritor mill, paint mill, or the like, in order to create smaller particles and a more stable suspension.

Electrorheological materials prepared in accordance with the present invention do not require ionic surface or bulk particle conductivity to achieve the necessary particle polarization to function in an electrorheological material. The particles of the present invention undergo atomic polarization which is caused by a distortion in the crystalline structure of the actual particle. The particles of the invention can therefore achieve a large polarization in the absence of water or any other activator and consequently function effectively over a very broad temperature range. The present electrorheological materials are also highly responsive to an applied electric field.

The application of an alternating electric current at a frequency of at least 500 Hz is crucial to the performance of the present electrorheological materials since at lower frequencies, parasitic electrophoretic effects can occur. Parasitic electrophoretic effects can be defined as the electric field-induced migration of charged particles towards one electrode. The occurrence of this phenomenon is particularly prevalent in substantially anhydrous electrorheological materials exposed to either direct current or low frequency alternating current fields. A more detailed description of electrophoretic effects is provided by Melcher in "Continuum Electromechanics" (MIT Press, Cambridge, Mass., 1981, p. 10–27), which is incorporated herein by reference. Attempts to reduce the velocity at which charge carriers will migrate towards an electrode by increasing the surface conductivity of the particles is unacceptable because of the increase in power requirements and temperature sensitivity of the resulting electrorheological material. It has been discovered that high frequency electric fields minimize or totally eliminate these electrophoretic effects such that the electrorheological material experiences the full force of the electric field and exhibits a substantial electrorheological effect over a broad temperature range. It has also been discovered that the utilization of an A.C. electric field with a frequency greater than or equal to 500 Hz results in a situation where the static and dynamic yield stress values exhibited by the electrorheological material are approximately equivalent. This is important due to the resulting simplification possible for the design of devices as described in detail hereinafter.

The present invention also encompasses a method of activating an electrorheological material by providing an appropriate carrier fluid, dispersing an atomically polarizable particle within the carrier fluid and exposing the resulting electrorheological material to an alternating current electric field at a frequency of at least 500 Hz. The carrier fluid and atomically polarizable particles have been described in detail above, as has the method of dispersing the particles in the fluid with and without the use of a surfactant or dispersing agent. The alternating current electric field may be applied through the use of electrodes as is well known in the art of electrorheological materials.

Evaluation of the mechanical/electrical properties and characteristics of the electrorheological materials of the present invention, as well as other electrorheological materials, can be accomplished with the utilization of concentric cylinder couette rheometry. The theory which provides the basis for this technique is adequately described by S. Oka in "Rheology, Theory and Applications" (volume 3, F. R. Eirich, ed., Academic Press, New York, 1960, pp. 17–82) which is incorporated herein by reference. The information that can be obtained from a concentric cylinder rheometer includes data relating mechanical shear stress to shear strain rate, the static yield stress and the electrical current density as a function of shear rate. For electrorheological materials, the shear stress versus shear rate data can be modeled after a Bingham plastic in order to determine the dynamic yield stress and viscosity.

The Bingham plastic model recognizes that the property of an electrorheological material generally observed to change with an increase in electric field is the yield stress ($\tau y$) defining the onset of flow. The electric field-induced yield stress ($\tau y$), and viscosity, $T_I$, are the two most significant parameters used in designing electroactive devices. The dynamic yield stress ($\tau y,d$) in a Bingham plastic-modeled electrorheological material can be defined as the zero-rate intercept of the linear regression curve fit. The static yield stress ($\tau y,s$) is defined as the stress necessary to initiate flow within the electrorheological material regardless of whether or not a Bingham model accurately describes the material's behavior. The viscosity of the material is accurately reflected by the slope of the linear regression curve fit used in the analysis. Many electrorheological materials exhibit a higher static yield stress than dynamic yield stress. The cause of this phenomenon, which is known as stiction, is not completely understood. In designing a device, it is necessary to consider the possible occurrence of stiction. It is advantageous for the design of devices if the electrorheological material exhibits a static) yield stress approximately equivalent to the dynamic yield stress. Materials having a static yield stress that is much different than the dynamic yield stress are difficult to control in a smooth, continuous manner. When used in devices, they result in discontinuous output where performance at any given time depends on the prior shear history of the fluid. It is also desirable for the zero-field yield stress and viscosity to be as low as possible in a given electrorheological material since this allows devices having the largest possible dynamic range to be built.

The test geometry that is utilized by concentric cylinder rheometers for the characterization of ER materials is a simple concentric cylinder couette cell configuration. The material is placed in the annulus formed between an inner cylinder of radius $R_1$ and an outer cylinder of radius $R_2$. One of the cylinders is then rotated with an angular velocity $\Omega$ while the other cylinder is held motionless. The relationship between the shear stress and the shear strain rate is then derived from this angular velocity and the torque, T, applied to maintain or resist it.

The following examples are given to illustrate the invention and should not be construed to limit the scope of the invention which is defined by the claims.

EXAMPLES 1 and 2

An electrorheological material is prepared by combining 50.0 g of titanium dioxide, 23.0 g of light mineral oil (Aldrich Chemical Co. 4/33,077–9) and 2.0 g of glycerol monooleate (KEMMESTER® 2000 from Witco Chemical Co.). The resulting combination of ingredients are mixed thoroughly in a beaker with a spatula, then vigorously shaken by hand in a closed container. Before use, the titanium dioxide is oven-dried in a convection oven for 24 hours at a temperature of 116° C. For Example 1, the titanium dioxide is in a rutile crystal form (Aldrich chemical Co. #22,422while for Example 2, the titanium dioxide is in an anatase crystal form (Aldrich Chemical Co., #23,203-3).

The dynamic properties of the electrorheological materials of Examples I and 2 are measured using concentric cylinder couette cell rheometry using various alternating current electric fields with a frequency of 500 Hz. The shear stress versus shear rate curves obtained for these materials are shown in FIGS. 1 and 2. The dynamic yield stress ($\tau y,d$) for these materials is defined as corresponding to the zero-rate intercept of the Bingham plastic linear regression curve fit and are therefore the y-intercepts of each plotted line in FIGS. 1 and 2. As can be seen from FIGS. 1 and 2, the dynamic yield stresses exhibited by the ruffle titanium dioxide-containing electrorheological material are much greater than those of the anatase titanium dioxide counterpart.

EXAMPLE 3

An electrorheological material is prepared by combining 51.29 g of rutile titanium dioxide (TI-PURE ® R100 containing 92 percent titanium dioxide, low chalk resistance—E. I. Du Pont de Nemours & Co.), 1.03 g isopropyltri(dioctyl)phosphato titanate (KEN-REACT ® KR12—Kenrich Petrochemical Inc.), and 33.59 g of 10 centistoke silicone oil (L-45—Union Carbide Silicones). The resulting combination of ingredients is thoroughly dispersed using a high speed disperser equipped with a 16-tooth rotary head. Before use, the titanium dioxide particles are oven-dried in a convection oven for 16 hours at a temperature of 125° C. The use of these weight amounts of ingredients corresponds to an electrorheological material containing 25 volume percent atomically polarizable particles.

EXAMPLES 4–15

Electrorheological materials based on atomically polarizable particles are prepared in accordance with Example 3. The volume percent of particles in the formulated electrorheological material was held at 25 percent in Examples 4–12 and 15 percent for Examples 13–15. The following amounts and types of particles, surfactants and oils describe those used in the corresponding examples:

| Example | Composition of Electrorheological Material |
|---|---|
| 4 | 50.63 g rutile titanium dioxide (TI-PURE ® R100), 5.06 g SOLSPERSE ® 3000 hyperdispersant, 0.51 g cetyl dimethicone copolyol polyglyceryl-4 isostearate hexyl laurate (ABIL ®-WE-09 - Goldschmidts Chemical Corp.), and 10 centistoke L-45 silicone oil (Union Carbide Silicones). |
| 5 | 52.75 g TI-PURE ® R100 titanium dioxide, 0.53 g glycerol dioleate (EMEREST ® 2410 - Henkel Corporation), 0.53 g ABIL ®-WE-09 polymeric surfactant, and light mineral oil (Aldrich Chemical Co.). |
| 6 | 48.45 g TI-PURE ® R100 titanium dioxide, 0.49 g trimethylsiloxy-hydroxyethoxypropyl polydimethylsiloxane (PS558 - Huls America Corp.), 0.49 g isopropyltri(dioctyl)phosphato titanate (KEN-REACT ® KR12 - Kenrich Petrochemical Inc.), and 32.17 g L-45 silicone oil. |
| 7 | 66.52 g TI-PURE ® R100 titanium dioxide, 6.72 g HYPERMER ® A60 (ICI Americas, Inc.) hyperdispersant and 38.77 g L-45 silicone oil. |
| 8 | 62.22 g TI-PURE ® R100 titanium dioxide, 3.16 g HYPERMER ® A60 hyperdispersant, 3.48 g EMEREST ® 2410 surfactant, and 34.53 g L-45 silicone oil. |
| 9 | 60.11 g barium titanate (Aldrich Chemical Co. #20,810-8), 0.60 g SOLSPERSE ® 3000 hyperdispersant, 0.06 g ABIL ®-WE-09 polymeric surfactant, and 35.15 g chlorinated paraffin oil (PAROIL ® 10 - Dover Chemical Co.). |
| 10 | 56.53 g barium titanate, 0.56 g SOLSPERSE ® 3000 hyperdispersant, 0.06 g ABIL ®-WE-09 polymeric surfactant, and 23.38 g light mineral oil. |
| 11 | 53.85 g barium titanate, 1.08 g KEN-REACT ® KR12 coupling agent, and 24.14 g L-45 silicone oil. |
| 12 | 44.91 g barium titanate, 0.90 g KEN-REACT ® KR12 coupling agent, 0.45 g ABIL ®-WE-09 polymeric surfactant, and 19.69 g L-45 silicone oil. |
| 13 | 6.93 g lead magnesium niobate (PMN - Materials Laboratory, Pennsylvania State University), 0.35 g SOLSPERSE ® 3000 hyperdispersant, 0.07 g ABIL ®-WE-09 polymeric surfactant, and 4.17 g light mineral oil. |
| 14 | 6.78 g lead zirconate titanate (PZT - Materials Laboratory, Pennsylvania State University), 0.34 g SOLSPERSE ® 3000 hyperdispersant, 0.07 g ABIL ®-WE-09 polymeric surfactant, and 4.23 g light mineral oil. |

-continued

| Example | Composition of Electrorheological Material |
|---|---|
| 15 | 6.70 g lead titanate (Materials Laboratory, Pennsylvania State University), 0.34 g SOLSPERSE ® 3000 hyperdispersant, 0.07 g ABIL ®-WE-09 polymeric surfactant, and 4.37 g light mineral oil. |

The dynamic electrorheological properties of Examples 3–15 are measured using concentric cylinder couette cell rheometry at various A.C. electric fields with a frequency of 1000 Hz. As shown in Table 1, all electrorheological materials are observed to exhibit a substantial electrorheological effect. This example illustrates that a variety of atomic polarizable particles, dispersants/surfactants and oils can be utilized in the composition of the present electrorheological material. In addition, Examples 3, 5, 6, 11 and 12 demonstrate that the lowest combination of zerofield properties (viscosity and yield stress) are obtained when a particle-bound surfactant, isopropyltri(dioctyl)phosphato titanate, is utilized as a dispersant. Therefore, particle-bound surfactants such as titanate, zirconate, or aluminate coupling agents are preferred for this reason, as well as for imparting stability to the electrorheological material over a broad temperature range.

TABLE 1

| Example | Zero-field viscosity (mPa/sec) | Zero-field $\tau y,d$ (Pa) | $\tau y,d$ (Pa) at 1 kV/mm | $\tau y,d$ (Pa) at 2 kv/mm | $\tau y,d$ (Pa) at 3 kV/mm |
|---|---|---|---|---|---|
| 3 | 190 | 94 | 116 | 186 | 302 |
| 4 | 223 | 140 | — | 222 | 431 |
| 5 | 411 | 75 | 98 | 183 | 335 |
| 6 | 157 | 77 | 99 | 161 | 275 |
| 7 | 203 | 317 | 490 | 569 | 774 |
| 8 | 180 | 226 | 255 | 318 | 522 |
| 9 | 780 | 0 | 173 | 761 | 1409 |
| 10 | 1390 | 4 | 146 | 690 | 1111 |
| 11 | 109 | 29 | 138 | 477 | 780 |
| 12 | 135 | 98 | 201 | 564 | 851 |
| 13 | 165 | 0 | 1 | 32 | 149 |
| 14 | 142 | 0 | 18 | 100 | 265 |
| 15 | 123 | 2 | 4 | 87 | 214 |

EXAMPLES 16–20

Electrorheological materials are prepared in accordance with Example 3 utilizing the following grades of TI-PURE ® rutile titanium dioxide (E. I. DuPont de Nemours & Co.):

| Example | Titanium Dioxide Grade | Description |
|---|---|---|
| 16 | R960 | 80% $TiO_2$, completely encapsulated with $SiO_2$ layer, high chalk resistant |
| 17 | R931 | 80% $TiO_2$, medium chalk resistance |
| 18 | R900 | 80% $TiO_2$, low chalk resistance |
| 19 | R901 | 80% $TiO_2$, medium chalk resistance |
| 20 | R902 | 80% $TiO_2$, medium to high chalk resistance |

The dynamic properties of the electrorheological materials of Examples 3 and 16–20 are measured using concentric cylinder rheometry at various A.C. electric fields with a frequency of 1000 Hz. As shown in Table 2, all electrorheological properties are observed to exhibit a similar electrorheological effect. Example 16 is observed to exhibit the lowest zerofield properties (viscosity and $\tau y,d$) while maintaining a high level of electrorheological activity when exposed to an electric field. These examples, therefore, indicate that the presence and amount of a surface coating (i.e., silica) increases the dispersability of the atomically polarizable particle in the carrier oil and thereby improves the zero-field properties of the overall electrorheological material.

TABLE 2

| Ex. # | Zero-field viscosity (mPa/sec) | Zero-field τy,d (Pa) | τy,d (Pa) at 1 kV/mm | τy,d (Pa) at 2 kv/mm | τy,d (Pa) at 3 kV/mm | τy,d (Pa) at 4 kV/mm |
|---|---|---|---|---|---|---|
| 3 | 190 | 94 | 116 | 186 | 302 | 473 |
| 16 | 189 | 70 | 98 | 168 | 310 | 581 |
| 17 | 359 | 317 | 336 | 430 | 572 | — |
| 18 | 152 | 135 | 146 | 199 | 318 | 486 |
| 19 | 252 | 168 | 194 | 255 | 372 | 558 |
| 20 | 123 | 76 | 90 | 134 | 222 | 367 |

EXAMPLE 21

An electrorheological material is prepared in accordance with Example 3 utilizing 610.0 g barium titanate (Aldrich Chemical Co. #20,810-8), 9.15 g KEN-REACT® KR12 titanate coupling agent (Kenrich Petrochemical Inc.), and 212.97 g L-45 silicone oil (Union Carbide Silicones). The static and dynamic mechanical properties of this e]electrorheological material are evaluated using concentric cylinder couette cell rheometry with a 3.0 kV/mm A.C. electric field over a range of frequencies (100 to 1000 Hz). As shown in Table 3, the dynamic yield stress approaches its maximum value at about 500 Hz. At this same frequency, the static yield stress becomes approximately equivalent to the dynamic yield stress. At frequencies greater than 500 Hz, both the static and dynamic yield stress values exhibit very little variation. At frequencies smaller than 500 Hz, the dynamic yield stress decreases due to parasitic electrophoretic effects, while the static yield stress increases due to stiction. For designing devices, the optimum performance of the electrorheological material is observed when the A.C. electric field frequency is greater than or equal to about 500 Hz as explained above.

TABLE 3

| A. C. Frequency (Hz) | Static Yield Stress at 3 kV/mm (Pa) | Dynamic Yield Stress at 3 kV/mm (Pa) |
|---|---|---|
| 100 | 1104 | 610 |
| 200 | 1425 | 1186 |
| 300 | 1521 | 1372 |
| 400 | 1695 | 1545 |
| 500 | 1827 | 1804 |
| 600 | 1754 | 1788 |
| 700 | 1723 | 1862 |
| 800 | 1764 | 1793 |
| 900 | 1805 | 1763 |
| 1000 | 1839 | 1792 |

EXAMPLE 22

In order to determine the survivability of the electrorheological material of the present invention to exposure and operation at broad temperature extremes, the dynamic electrorheological properties of the electrorheological material prepared in Example 21 are evaluated after operation at both low and high temperatures. The electrorheological material is allowed to thermally equilibrate at −25° C. prior to testing at a 0, 2 and 3 kV/mm A.C. electric field strength (frequency=1000 Hz). The first sample is then returned to 25° C. and retested. The same procedure is utilized for the electrorheological material at 125° C. for the second sample. The zero-field properties and electrorheological properties of these two samples are compared with properties at 25° C. of the material prior to operation at high and low temperatures. As shown in Table 4, the electrorheological material is capable of being exposed to a broad temperature range without any detrimental effect on its electrorheological properties once returned to normal temperatures.

TABLE 4

| Sample | Sample Description | Zero-field viscosity (mPa/sec) | Zero-field yield stress (Pa) | τy,d (Pa) at 2 kv/mm | τy,d (Pa) at 3 kV/mm |
|---|---|---|---|---|---|
| 0 | As prepared (initial) | 539 | 101 | 1003 | 1792 |
| 1 | After −25° C. Exposure/ Operation | 499 | 102 | 866 | 1745 |
| 2 | After 125° C. Exposure/ Operation | 485 | 115 | 945 | 1904 |

EXAMPLE 23

An electrorheological material is prepared in accordance with Example 3 utilizing 50.20 g TI-PURE® R960 ruffle titanium dioxide (E. I. DuPont de Nemours & Co.), 1.02 g KEN-REACT® KR12 coupling agent (Kenrich Petrochemicals Inc.), and 33.52 g L-45 silicone oil (Union Carbide Silicones). The dynamic electrorheological properties of this material are evaluated with concentric cylinder couette rheometry at 0, 1, 2, and 3 kV/mm using alternating current applied at a frequency of 1000 Hz. Measurements of the dynamic properties for the electrorheological material are obtained at −25°, 0°, 25°, 50°, 75°, 100°, 125°, and 150° C. As shown in FIG. 3, the electrorheological material is observed to exhibit a substantial electrorheological effect over this broad temperature range. In addition, the current density exhibited by the electrorheological material over this temperature range is observed to remain within about 25 percent of its value measured at 25° C. as shown in Table 5. This small deviation over a broad temperature range is significant because the current density exhibited by the electrorheological material direct]y correlates with the power consumption expected for a device. Any differences in performance observed over this temperature range can be accounted for by the change in viscosity and thermal expansion of the carrier oil.

TABLE 5

| Temp. (°C.) | Percent Change in Current Density at 1 kV/mm | Percent Change in Current Density at 2 kV/mm | Percent Change in Current Density 3 kV/mm |
|---|---|---|---|
| −25 | −3 | −3 | −6 |
| 0 | −3 | −3 | −2 |
| 25 | 0 | 0 | 0 |
| 50 | +3 | +3 | +3 |
| 75 | +5 | +8 | +6 |
| 100 | +4 | +13 | +6 |
| 125 | +5 | +9 | +17 |
| 150 | +5 | +17 | +23 |

As can be seen from Examples 22 and 23, electrorheological materials according to the present invention exhibit substantial performance over a broad temperature range. The consistent performance of the present materials at the diverse temperatures described above is unique to the present invention and can rarely be duplicated or approximated by traditional electrorheological materials.

It is understood that the foregoing is a description of the preferred embodiments of the present invention and that the scope of the invention is not limited to the specific terms and conditions set forth above but is determined by the following claims.

What is claimed is:

1. A method of activating an electrorheological material to achieve a change in apparent viscosity comprising the steps of:

(a) providing an electrically insulating liquid as a carrier fluid;

(c) dispersing an atomically polarizable particle within the carrier fluid; and (d) exposing the resulting electrorheological material to an alternating current electric field of a frequency from 500 to 2000 Hz.

2. A method according to claim 1 wherein the atomically polarizable particle is a crystalline particle which is composed of ionic crystals in which positive ions and negative ions can slightly shift relative to each other in the presence of an applied electric field.

3. A method according to claim 2 wherein the particle belongs to a non-centrosymmetric crystallographic group.

4. A method according to claim 3 wherein the crystallographic group is selected from the group consisting of Triclinic [1], Monoclinic [2], Monoclinic [m], Orthorhombic [mm2], Orthorhombic [222], Tetragonal [4], Tetragonal [4 mm], Tetragonal [$\bar{4}$2 m], Tetragonal [22], Trigonal [3], Trigonal [3 m], Trigonal [32], Hexagonal [6], Hexagonal [6 mm], Hexagonal [$\bar{6}$], Hexagonal [6m2], Hexagonal [622], Cubic [$\bar{3}$ m], and Cubic [23].

5. A method according to claim 1 wherein the atomically polarizable particle is selected from the group consisting of titanium dioxide, lithium niobate, sodium chloride, potassium dihydrogen phosphate, lead magnesium niobate, barium titanate, strontium titanate, lead titanate, lead zirconate titanate and mixtures thereof.

6. A method according to claim 5 wherein the atomically polarizable particle is titanium dioxide, barium titanate, or lead zirconate titanate.

7. A method according to claim 6 wherein the titanium dioxide exists in the ruffle structural form.

8. A method according to claim 1 wherein the atomically polarizable particle has a coated surface.

9. A method according to claim 8 wherein the particle is encapsulated with a silica layer.

10. A method according to claim 1 wherein the carrier fluid is selected from the group consisting of mineral oils, silicone oils, white oils, paraffin oils, chlorinated hydrocarbons, transformer oils, halogenated aromatic liquids, halogenated paraffins, diesters, polyoxyalkylenes, perfluorinated polyethers, fluorinated hydrocarbons, fluorinated silicones and mixtures thereof.

11. A method according to claim 10 wherein the carrier fluid is selected from the group consisting of silicone oils, mineral oils, and perfluorinated polyethers.

12. A method according to claim 1 wherein the dispersing agent is a particle-bound dispersing agent.

13. A method according to claim 12 wherein the particle-bound dispersing agent is a coupling agent selected from the group consisting of titanate, zirconate, and aluminate coupling agents, and combinations thereof.

14. A method according to claim 13 wherein the coupling agent is selected from the group consisting of isopropyltri(dioctyl)phosphato titanate, neopentyl(diallyl)oxytri(dioctyl)pyrophosphato zirconate, and neopentyl(diallyl)oxytri(dioctyl)phosphato titanate.

15. A method according to claim 1 wherein the electrorheological material comprises from about 5 to 50 percent by volume of an atomically polarizable particle and from about 50 to 95 percent by volume of a carrier fluid.

16. A method according to claim 1 wherein the electrorheological material further comprises from about 0.1 to 10 percent by weight of a dispersing agent relative to the weight of the particle component.

17. A method according to claim 16 wherein the particle component is present in an amount from about 15 to 40 percent by volume, the carrier fluid is present in an amount from about 60 to 85 percent by volume, and the dispersing agent is present in an amount from about 0.5 to 4 percent by weight relative to the weight of the particle component.

* * * * *

UNITED STATES PATENT AND TRADEMARK OFFICE

CERTIFICATE OF CORRECTION

PATENT NO. : 5,417,874

DATED : May 23, 1995

INVENTOR(S) : J. David Carlson, et al.

It is certified that error appears in the above-indentified patent and that said Letters Patent is hereby corrected as shown below:

Col. 1, line 57, replace "$TiO_9$" with --$TiO_2$--.

Col. 4, line 18, replace "futile" with --rutile--; line 19, replace "futile" with --rutile--; line 23, replace "futile" with --rutile--.

Col. 7, line 64, replace "$T_l$", with --$\eta$--.

Col. 8, line 14, delete ")" ; line 43, replace "4/33,077-9" with --#33,077-9--; line 51, replace "#22,422" with --#22,422-7),--; line 55, replace "I" with --1--; line 65, replace "ruffle" with --rutile--.

Col. 10, line 40, replace "165" with --168--.

Col. 12, line 48, replace "ruffle" with --rutile--; line 67, replace "direct[y" with --directly--.

Claim 1; line 37, add --(b) providing a dispersing agent in the carrier fluid;--; line 41, replace "2000" with --1000--.

Claim 4; line 55, after Tetragonal [4 mm], add --Tetragonal [$\bar{4}$]--; line 2, replace "[6m2]" with --[$\bar{6}$m2]--.

Claim 7, line 13, replace "ruffle" with --rutile--.

UNITED STATES PATENT AND TRADEMARK OFFICE

CERTIFICATE OF CORRECTION

PATENT NO. : 5,417,874

DATED : May 23, 1995

INVENTOR(S) : J. David Carlson, et al.

It is certified that error appears in the above-indentified patent and that said Letters Patent is hereby corrected as shown below:

Column 10, lines 23-24, "fiuorinated hydrocarbons" should be deleted.

Signed and Sealed this

Twenty-first Day of November, 1995

*Attest:*

Bruce Lehman

BRUCE LEHMAN

*Attesting Officer*

*Commissioner of Patents and Trademarks*